US008434465B2

(12) United States Patent
Call

(10) Patent No.: US 8,434,465 B2
(45) Date of Patent: May 7, 2013

(54) BLOWBACK ASSEMBLY

(75) Inventor: Kenneth A. Call, Henrietta, NY (US)

(73) Assignee: Crosman Corporation, East Bloomfield, NY (US)

( * ) Notice: Subject to any disclaimer, the term of this patent is extended or adjusted under 35 U.S.C. 154(b) by 406 days.

(21) Appl. No.: 12/508,696

(22) Filed: Jul. 24, 2009

(65) Prior Publication Data

US 2011/0017188 A1 Jan. 27, 2011

(51) Int. Cl.
*F41B 11/00* (2006.01)
*F41B 11/32* (2006.01)

(52) U.S. Cl.
USPC ..... 124/73; 124/71; 124/75

(58) Field of Classification Search ..... 124/56, 124/71, 73, 75
See application file for complete search history.

(56) References Cited

U.S. PATENT DOCUMENTS

| | | | | |
|---|---|---|---|---|
| 3,103,212 | A | 9/1963 | Merz | |
| 3,547,095 | A | 12/1970 | Vadas et al. | |
| 3,548,802 | A * | 12/1970 | Green | 124/70 |
| 4,986,251 | A | 1/1991 | Lilley | |
| 5,476,087 | A * | 12/1995 | Kunimoto | 124/73 |
| 5,704,150 | A | 1/1998 | Milliman | |
| 5,884,615 | A * | 3/1999 | Casas Salva | 124/71 |
| 6,026,797 | A | 2/2000 | Maeda et al. | |
| RE39,805 | E * | 9/2007 | Maeda et al. | 124/74 |
| 7,267,119 | B2 | 9/2007 | Maeda et al. | |
| 7,766,000 | B2 * | 8/2010 | Maeda | 124/74 |
| 7,856,969 | B2 * | 12/2010 | Maeda et al. | 124/71 |
| 7,950,381 | B2 * | 5/2011 | Maeda | 124/51.1 |
| 2005/0064782 | A1 * | 3/2005 | Kunimoto | 446/210 |
| 2006/0162711 | A1 * | 7/2006 | Maeda et al. | 124/73 |
| 2007/0181116 | A1 * | 8/2007 | Wei | 124/74 |
| 2007/0272222 | A1 * | 11/2007 | Ho | 124/73 |
| 2008/0017180 | A1 * | 1/2008 | Maeda et al. | 124/74 |
| 2009/0056692 | A1 * | 3/2009 | Maeda | 124/63 |
| 2009/0139507 | A1 * | 6/2009 | Maeda | 124/48 |
| 2010/0319668 | A1 * | 12/2010 | Maeda | 124/73 |
| 2011/0000474 | A1 * | 1/2011 | Wood | 124/73 |

FOREIGN PATENT DOCUMENTS

EP 0341090 A2 11/1989

* cited by examiner

*Primary Examiner* — Bret Hayes
*Assistant Examiner* — Joshua Freeman
(74) *Attorney, Agent, or Firm* — Brian B. Shaw, Esq.; Harter Secrest & Emery LLP

(57) ABSTRACT

A blowback assembly for an airgun includes a valve body and a valve stem disposed within and movable with respect to the valve body. The valve stem has a stepped outer profile and the valve body defines a passageway having a stepped inner profile. The valve stem is normally biased against the valve body to form a seal containing a compressed gas in a valve stem chamber forming part of the passageway of the valve body. When the valve stem is moved from the normal position, compressed gas is expelled from the valve stem chamber to cock the airgun and to fire a projectile from the airgun.

20 Claims, 15 Drawing Sheets

BLOWBACK ASSEMBLY

CROSS-REFERENCE TO RELATED APPLICATIONS

Not applicable

STATEMENT REGARDING FEDERALLY SPONSORED RESEARCH OR DEVELOPMENT

Not applicable

REFERENCE TO A "SEQUENCE LISTING"

Not applicable

BACKGROUND OF THE INVENTION

1. Technical Field

The present invention relates to guns. More specifically, the invention relates to an improved blowback mechanism for airguns.

2. Description of Related Art

Airguns are well known in the art. Generally speaking, an airgun uses compressed air to fire ammunition through a barrel. The compressed air may be contained in a reservoir or cartridge contained directly in the gun, e.g., in the handle of the gun, or it may be supplied through a hose or the like from an external reservoir. Airguns are often used for "plinking" and also may be used to hunt small animals.

Airguns generally are designed to operate like standard firearms. One conventional design includes a hammer that must be cocked before each firing. The cocked hammer, when released by pulling the trigger, contacts the back end of a firing pin that unseats a seal, allowing air to pass from the reservoir into the path of the barrel, firing ammunition contained in the gun. In this relatively simplistic design, the hammer must be cocked each time the gun is to be fired.

In some applications, it is undesirable to require a user to manually cock the gun before each firing. For example, manually cocking slows the rate at which ammunition can be discharged. Accordingly, there is need in the art for an airgun that fires ammunition at a greater rate, preferably without the need to manually re-cock a hammer before firing.

U.S. Pat. No. 7,267,119 describes a blowback mechanism for use in an airgun that allows the gun to operate as a "semi-automatic". Specifically, the blowback mechanism is intended to automatically re-cock the airgun each time the gun is fired. The blowback mechanism of the '119 patent has many drawbacks, however. For starters, it is quite intricate and therefore difficult to fabricate. Moreover, in practice, that mechanism has some inefficiencies and failure points. There also is a need for an improved airgun capable of semi-automatic firing.

Thus, there is a need in the art for an improved blowback mechanism that facilitates semi-automatic firing of an airgun.

SUMMARY OF THE INVENTION

The present invention remedies the foregoing needs in the art by providing an improved blowback mechanism for an airgun and an improved airgun.

BRIEF DESCRIPTION OF THE DRAWING FIGURES

DETAILED DESCRIPTION OF THE INVENTION

Figure 1:
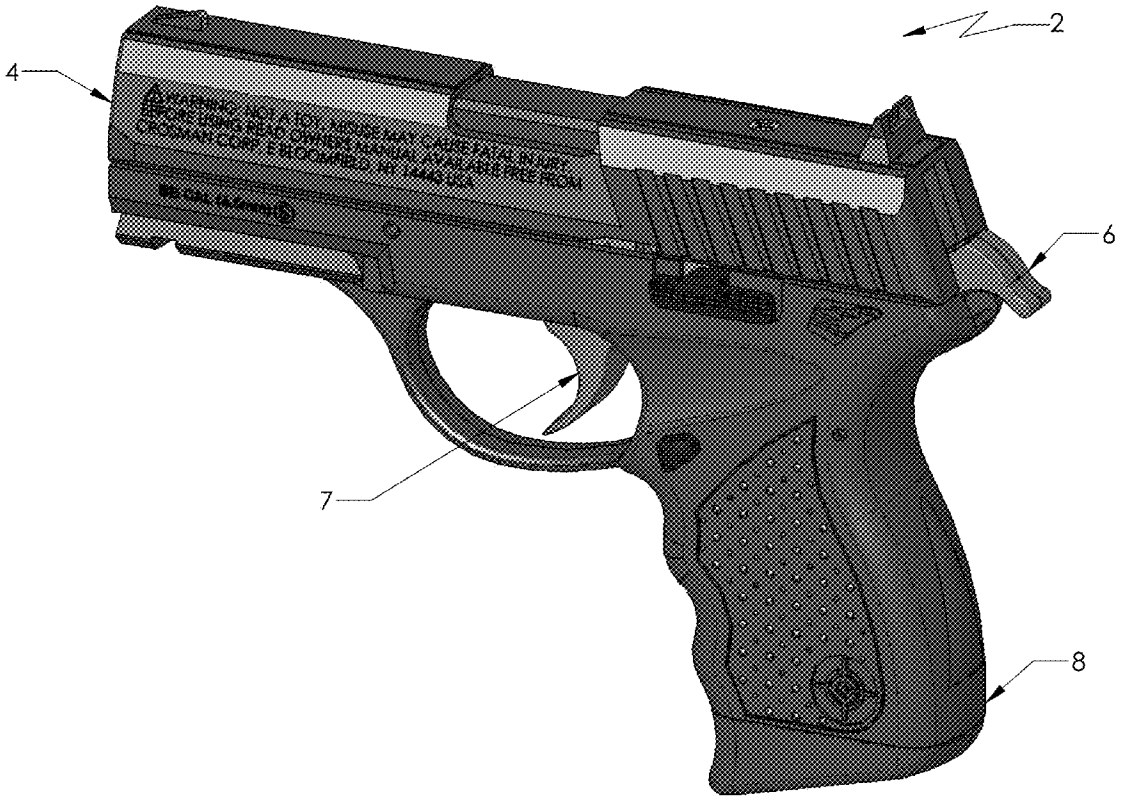
FIG. 1 is a perspective view of an airgun according to a preferred embodiment of the invention.

Preferred embodiments of the invention now will be described with reference to the drawing figures.

As illustrated in FIG. 1, an airgun 2 according to the invention generally includes a muzzle 4, a hammer 6, a trigger 7 in communication with the hammer 6, and a grip, or stock, 8. A cylindrical barrel 9 (shown in FIGS. 10A-10F) is disposed in the gun, terminating at the muzzle 4. The axis of the barrel 9 defines a firing axis along which projectiles are fired from the muzzle 4. Although not shown in FIG. 1, a compressed gas source and a cartridge containing projectiles are disposed in the grip 8.

Throughout this description, relative terms are used to define positions of components with respect to each other. For example, the terms "forward" or "in front of" are used to define a spatial relationship in which a component is on a side closer to the muzzle of the gun, as shown in FIG. 1. Similarly, the terms "rearward", "rear", and "back" are used to define a position that is on a side closer to the hammer of the gun. Such terms are intended to be relative to the airgun, not to the drawing Figures.

Operation of the airgun 2 is similar to the operation of a conventional airgun. Specifically, a user cocks the hammer 6 to ready the gun for firing. Upon pulling the trigger 7, the hammer 6 releases and causes compressed air to be fired from the barrel 9, expelling a projectile placed in line with the barrel 9. Unlike conventional airguns, however, the airgun 2 of the present invention includes a blowback mechanism that automatically re-cocks the gun 2 each time a projectile is fired. The blowback mechanism 10 is shown in detail in FIG. 2, and generally includes a valve body 11 and a valve stem 20.

In the illustrated embodiment, the valve body 11 includes two portions, namely, a stepped valve body portion 12 (also illustrated in FIG. 3) and a valve stem retainer 30. The stepped valve body portion 12 and the valve stem retainer 30 are fixed together to form the unitary valve body 11. The valve body 11 defines a generally cylindrical internal passageway 13 formed about an axis that, when the valve body 11 is disposed in the airgun 2, substantially coincides with the firing axis of the gun. The internal passageway 13 of the valve body 11 has a stepped profile, that is, it comprises a number of inner diameters. A relatively larger inner diameter d1 of the stepped valve body portion 12 defines a valve stem chamber 14, a smaller inner diameter d2 disposed forward of the valve stem chamber 14 defines a gas expansion chamber 40, and a still smaller inner diameter d3 disposed forward of the gas expansion chamber 40 defines a gas expulsion chamber 47. The internal passageway also includes a blowback opening 31 formed through the rear wall of the valve stem chamber 14 and having an inner diameter d4 less than the inner diameter d1 of the valve stem chamber 14.

The external surface of the valve body 11 preferably also is stepped. Specifically, the outer diameter of the valve body 11 formed about the gas expulsion chamber 47 preferably is smaller than the outer diameter formed about the gas expansion chamber 40 and/or the valve stem chamber 14. The relatively smaller diameter formed about the gas expulsion chamber 47 forms a gas expulsion nozzle 46, which will be described in more detail, below.

Figure 3:
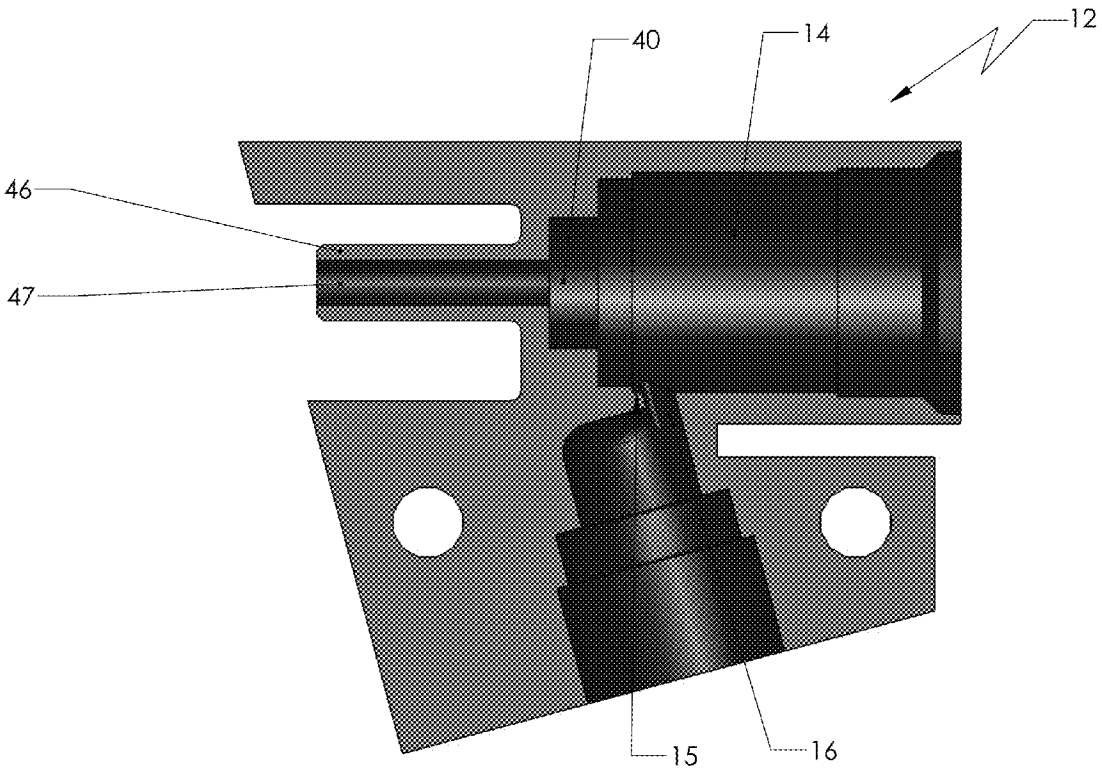
FIG. 3 is a cross-sectional view of a portion of a valve body used in the blowback assembly illustrated in FIG. 2.

While the stepped valve body portion 12 of the valve body 11 shown in FIG. 3 is illustrated as being a single piece, such is not required. For example, in one alternative embodiment, the gas expulsion nozzle 46 may be formed separately from the remainder of the stepped valve body portion 12, with the two components fixed together after formation. For example, the gas expulsion nozzle could be threadably engaged to a front surface of a truncated stepped valve body portion 12 or the two pieces could be welded together. Other known fastening means also could be used.

Figure 2:
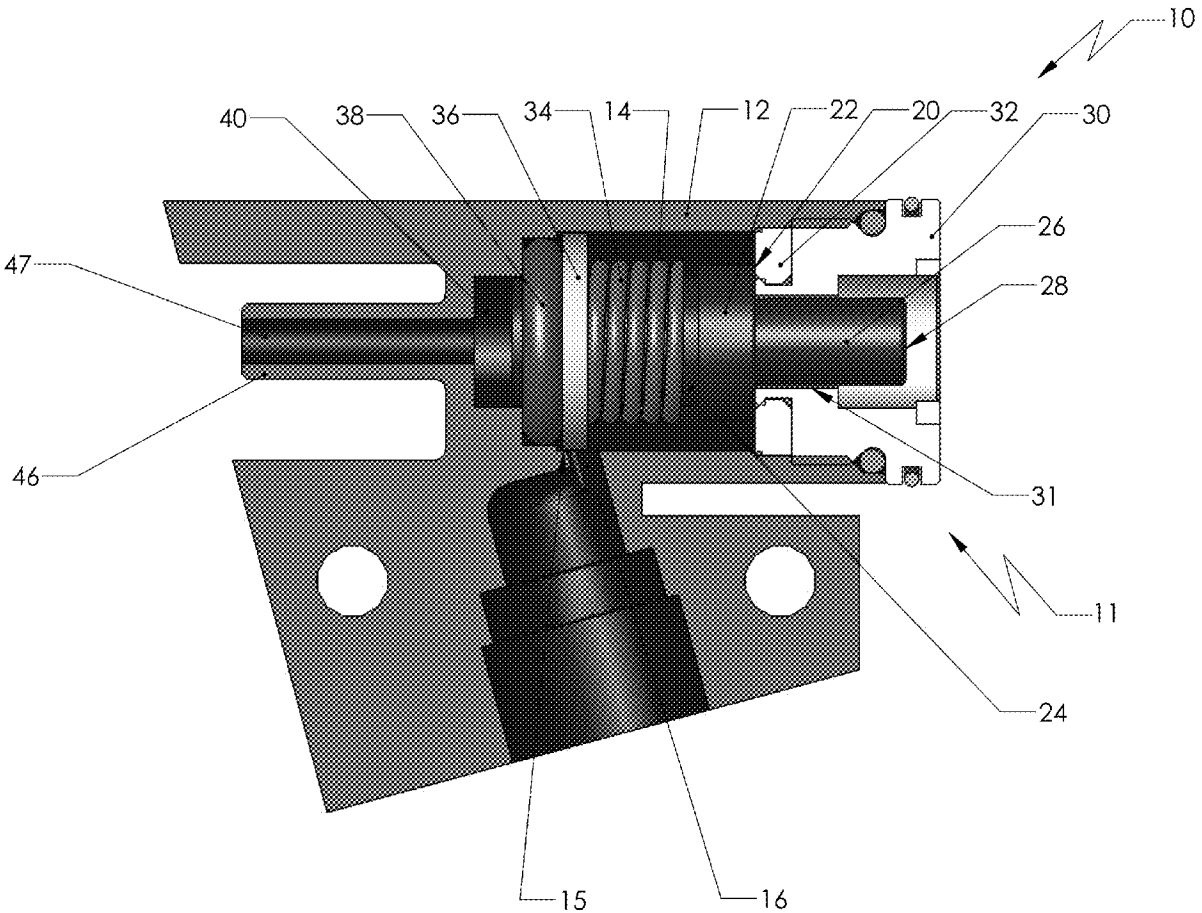
FIG. 2 is a cross-sectional view of a portion of a blowback assembly of the airgun of claim 1, according to a preferred embodiment of the invention.

As illustrated in FIG. 2, the valve stem retainer 30 is disposed at the rear end of the stepped valve body portion 12 with the two components together forming the valve body 12. The retainer 30 forms a rear, inner surface of the valve stem chamber 14 and contains the blowback opening 31 formed axially therethrough. According to this construction, the internal passageway 13 is defined by both the stepped valve body portion 12 and the valve seal retainer 30, fixed thereto. That is, the internal passageway 13 includes the gas expulsion chamber 47, the gas expansion chamber 40, the valve stem chamber 14, and the blowback opening 31.

Figure 4:
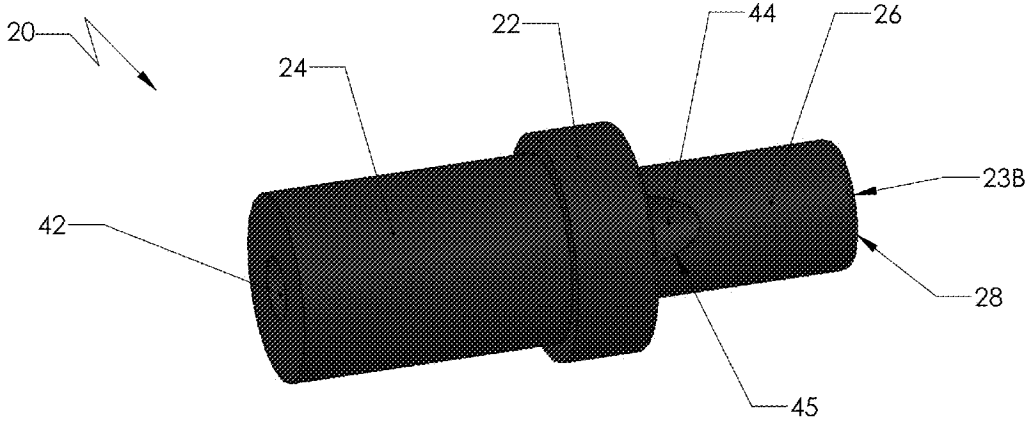
FIG. 4 is a perspective view of a valve stem used in the blowback assembly illustrated in FIG. 2.

The valve stem 20, also illustrated in FIG. 4, is disposed within, and movable in the axial direction with respect to, the valve body 11. The valve stem 20 is generally cylindrical and has a stepped outer profile. More particularly, the valve stem 20 includes an annular valve seat 22 arranged at an axially intermediate position of opposite front and rear faces 23*a*, 23*b* of the valve stem 20. A forward portion 24 of the valve stem 20 extends from the front face 23*a* to the annular valve seat 22, and a rearward portion 26 of the valve stem 20 extends from the rear face 23*b* to the annular valve seat 22. The annular valve seat 22 has an outer diameter greater than both an outer diameter of the forward portion 24 of the valve stem 20 and an outer diameter of the rearward portion 26 of the valve stem 20. As illustrated in FIG. 4, the forward portion 24 of the valve stem 20 has a greater diameter than the rearward portion 26 of the valve stem 20. The rear face 23*b* forms a striking surface 28.

As best illustrated in FIG. 4, the valve stem 20 also includes an axial bore 42 and at least one diagonal orifice 44. The axial bore 42 is formed in the front face 23*a* of the valve stem 20 and extends into the valve stem 20 a predetermined depth. The diagonal orifice 44 includes an opening 25 formed in the side of the rearward portion 26 of the valve stem 20 and terminates in the axial bore 42. Accordingly, the diagonal orifice 44 provides a passageway to communicate from outside the rearward portion 26 of the valve stem 20 to the axial bore 42. In another embodiment, the opening could alternatively or additionally be formed in a back surface of the annular valve seat 22, and still properly function in the invention.

The valve stem 20 is disposed in the airgun 2 such that the annular valve seat 22 is contained within the valve stem chamber 14, the rearward portion 26 of the valve stem 20 is disposed in the rear axial opening 31, and the forward portion 24 of the valve stem 20 is contained within the gas expansion chamber 40. As noted above, the valve stem 20 is movable in an axial direction with respect to the valve body 11. In a normal position, the valve stem 20 is biased toward the hammer end of the gun by a valve stem return spring 34, as illustrated in FIG. 2. In this position, a seal is formed between the valve stem 20 and the valve body 11 to preclude the flow of compressed gas from within the valve stem chamber 14. Also in this position, the opening 25 of the valve steam 20 is not in communication with the valve stem chamber 14, so no compressed gas is introduced into the diagonal orifice 44. When the striking surface of the valve stem 20 is struck with sufficient force to overcome the bias force biasing the valve stem 20 toward the hammer end of the gun, the valve stem 20 moves toward the muzzle end of the gun to a firing position, in which compressed gas flows from the valve stem chamber 14, into the blowback opening 31 as well be described in more detail below.

In the illustrated embodiment, in the normal position, the seal is formed between the annular valve seat 22 of the valve stem 20 and a seal 32 retained in the valve stem retainer 30 to circumscribe the blowback opening 31. In an alternative embodiment, the valve seat 22 could incorporate a seal such as the illustrated seal 32, which would contact a surface of the valve stem retainer 30 in the normal position of the valve stem 20 to contain the compressed gas in the valve stem chamber. Other sealing arrangements also will be apparent to those of ordinary skill in the art.

As noted above, the gas expansion chamber 40 is formed on the muzzle side of the valve stem chamber 14 and is sized to provide a clearance or sliding fit such that the forward portion 24 of the valve stem 20 slides freely (in the axial direction) with respect thereto. A packing press washer 36 and a ring packing 38 are provided between the gas expansion chamber 40 and the valve stem chamber 14. The ring packing 38 forms a sliding seal against the outer periphery of the forward portion 24 of the valve stem 20 to substantially prevent the flow of gas to and from the valve stem chamber 14 from and to the gas expansion chamber 40, around the forward portion 24 of the valve stem 20.

As previously noted, the annular valve seat 22 of the valve stem 20 is biased toward the hammer end of the gun to create a seal with the valve body by the valve stem return spring 34. The opening 25 formed in the valve stem 20 is arranged outside of the valve stem chamber 14, i.e., behind the seal formed at the valve seal 32 and the annular valve seat 22, such that gas contained in the valve stem chamber 14 does not enter the opening 25. Gas is introduced into the valve stem chamber 14 via a gas supply port 15 formed in a side of the valve stem chamber 14, and is contained in the valve stem chamber 14 because of the seals formed at the valve seal 32 and the ring packing 38. Gas is supplied at the supply port 15 by a compressed gas reservoir (not shown), which may be located in the gun, e.g. via a cartridge releasably secured to the gun, or may be an external reservoir communicating with the supply port 15 via some known conduit (not shown).

Although the valve body 11 and the valve stem 20 are illustrated as substantially circular cross-sections, such is not required. Any shape cross-section may be used without departing from the spirit and scope of the invention, however, non-circular cross-sections may require more work at assembly, as proper registration of the parts will be crucial to ensure proper functioning, including proper sealing.

Other modifications also are contemplated. For example, in FIG. 2 the valve stem retainer 30 is formed separately from the stepped valve body portion 12 mainly to facilitate insertion of the valve stem 20 into the internal passageway 13. The valve stem retainer 30 may be secured to the valve body 12 using in any known method, including threaded engagement, press fit, adhesive, or the like. Regardless of the method of attachment, in the preferred embodiment the gas expulsion chamber 47, the gas expansion chamber 40, the valve stem chamber 14, and the blowback opening 31 form a continuous passageway, with varying diameters, from muzzle-side to hammer side. This defined continuous passageway could be readily achieved through arrangements other than the described stepped valve body portion 12 and valve stem retainer 30 combination. For example, the stepped valve body portion 12 could be shorter and the valve seal retainer could incorporate a portion of the sidewall of the valve body defining the valve stem chamber 14 and/or the gas expansion chamber 40. In another embodiment, the valve stem retainer 30 and the stepped valve body portion 12 could be a single piece separable along a plane coinciding with the axis of the valve body 11. In such an embodiment, the two halves of the valve body 11 could be separated to facilitate insertion of the valve stem 12 and re-joined to contain the valve stem 20 within the valve body 11. The valve body 11 could alternately include more than two pieces.

Figure 5:
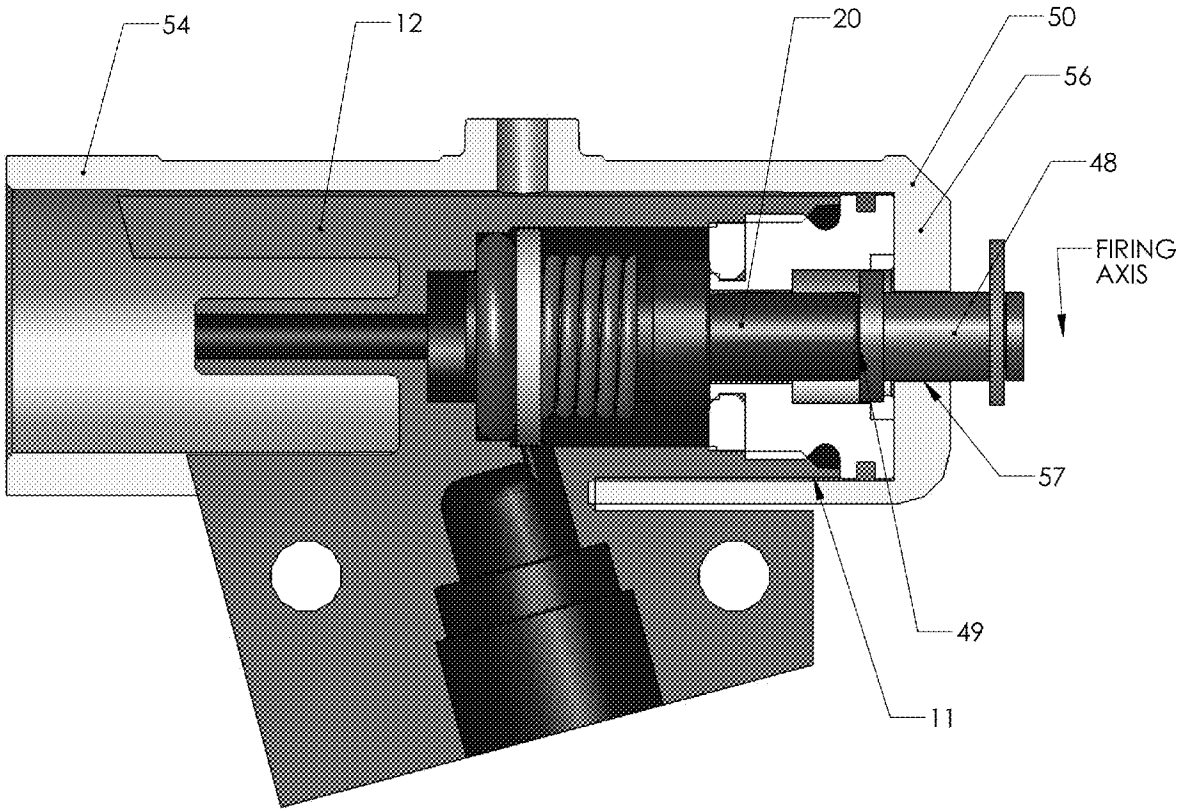
FIG. 5 is a cross-sectional plan view of an expanded portion of the blowback assembly of the airgun of FIG. 1.
Figure 6:
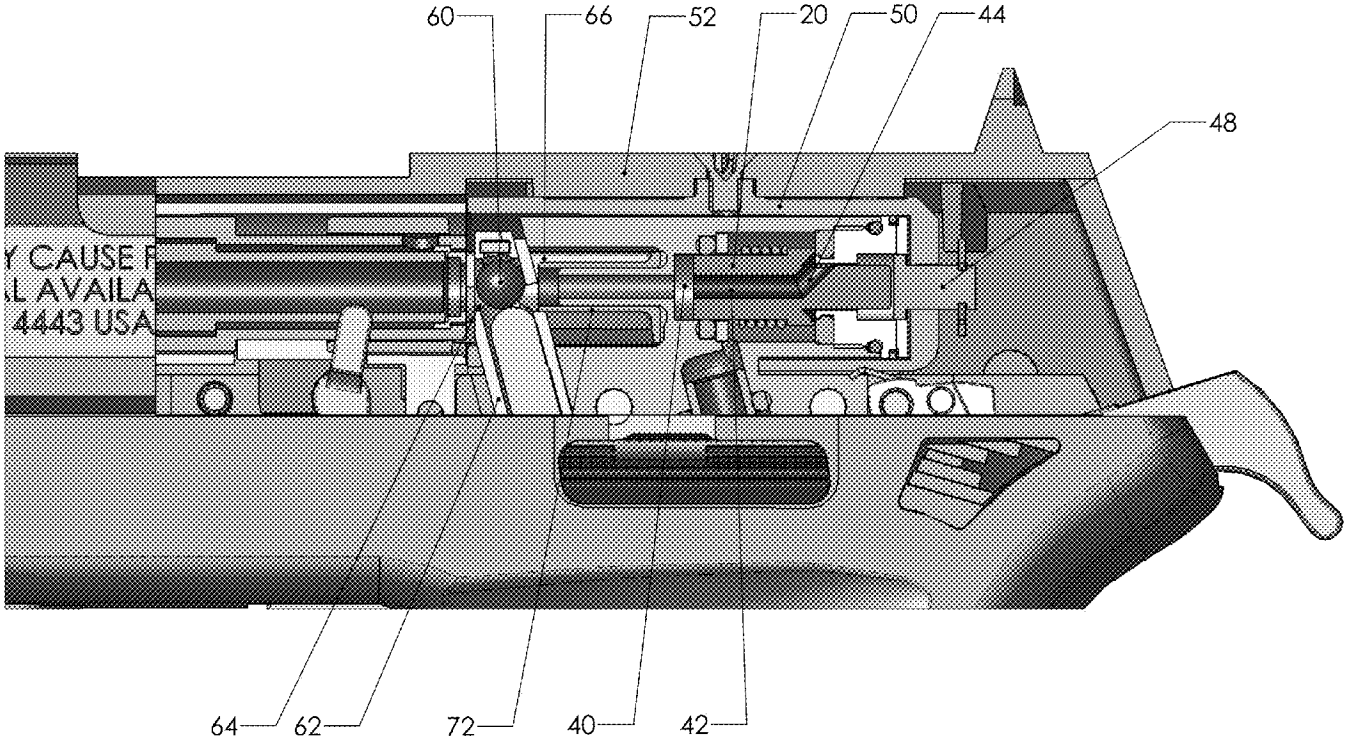
FIG. 6 is a partial cross-sectional view of a portion of the airgun of FIG. 1

As illustrated in FIG. 5, the valve body 11 is disposed within a cylinder 50, and the cylinder 50 is fixed to a slide 52 (shown in FIG. 6). The cylinder/slide combination is movable relative to the valve body 12 in a direction parallel to the firing axis. The cylinder 50 includes a generally cylindrical sidewall 54 terminating in a backwall 56. Portions of the sidewall spaced from the backwall may be removed to facilitate free motion of the cylinder in an axial direction, i.e., so as to not interfere with other components of the airgun 2. The inner periphery of the cylindrical sidewall 54 is sized to receive and slide relative to the valve body 11. A wiper seal 58 is provided on an outer diameter of the valve body 11 to contact an inner surface of the cylindrical sidewall 54, to prevent leakage of gas therebetween.

A through hole 57 is formed through the backwall 56 of the cylinder 50 and a hit pin 48 is contained in the through hole 57, axially movable with respect to the cylinder 50. The hit pin 48 is aligned axially with the striking surface 28 of the valve stem 20. A flange 49 is provided on an end of the hit pin 48 proximate the striking surface 28 and an e-clip or the like is provided proximate the opposite end of the hit pin to retain the hit pin in the through hole 57.

As noted above, the cylinder/slide combination is movable along the firing axis. In a forward-most or normal position, shown in FIG. 5, the inner surface of the backwall 56 of the cylinder 50 is arranged adjacent the valve body (the valve stem retainer 30 of the valve body 11 in the illustrated embodiment), and the striking surface 28 of the valve stem is contactable by movement of the hit pin 48 in a direction toward the muzzle 4. In relatively rearward, or cocking positions, the inner surface of the backwall 56 of the cylinder 50 is spaced from the valve stem retainer 30.

As will be described in more detail below, compressed gas is discharged from the gas expulsion nozzle 46 to fire a projectile 60 from the barrel 9. The projectile 60 is fed into a projectile firing position along the firing axis by a projectile feed cartridge 62, illustrated in FIG. 6. The projectile feed cartridge 62 has an output 64 arranged on a muzzle side of the gas expulsion nozzle 46 of the valve body 12. Projectiles 60 disposed in the projectile feed cartridge 62 are biased toward the output 64 using a spring, gravity, or the like.

Figure 7:
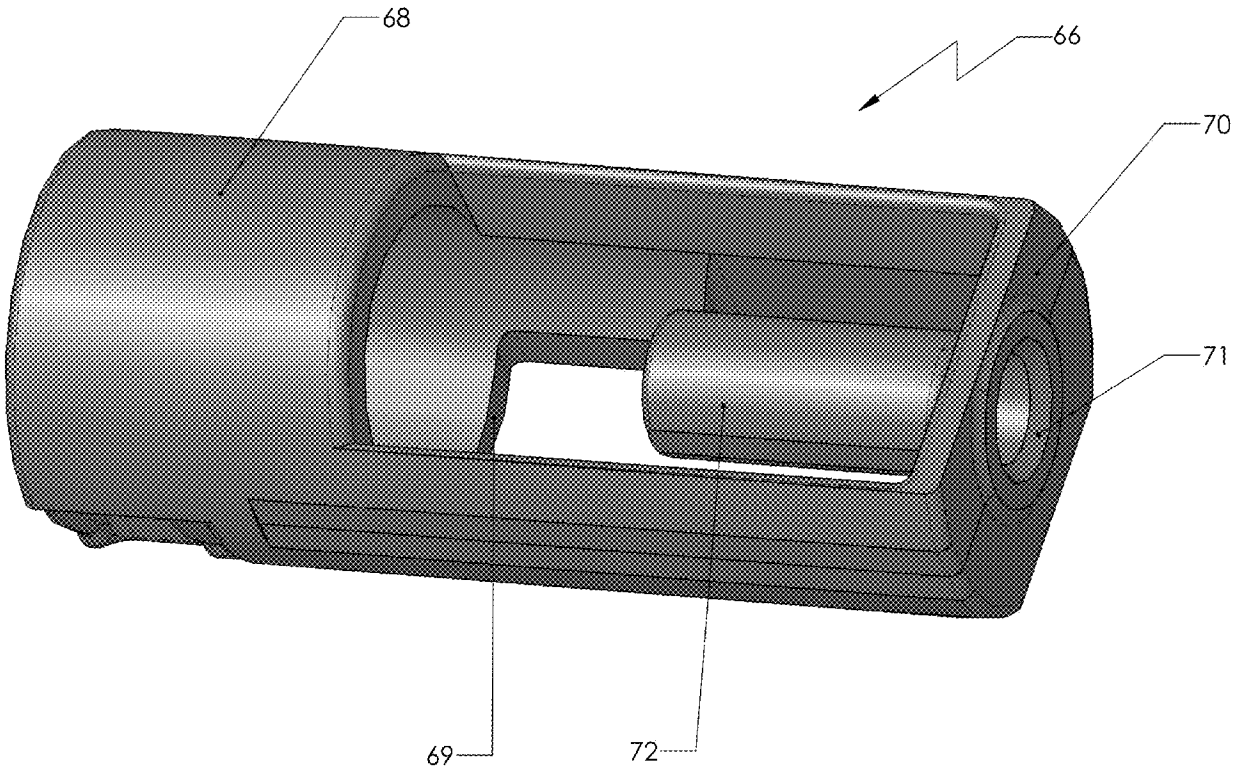
FIG. 7 is a perspective view of a projectile control mechanism used in the preferred blowback assembly of the present invention.

Movement of the projectile 60 once in the projectile firing position is controlled by a projectile control mechanism 66. As illustrated in detail in FIG. 7, the projectile control mechanism 66 has a generally cylindrical sidewall 68 terminating at a backwall 70. Portions of the sidewall 68 are removed. In particular, a bottom slot 69 is provided in the sidewall 68 extending forward from the backwall 70 such that the sidewall 68 does not interfere with the output 64 of the projectile feed cartridge 62. In addition, an axial through hole 71 is provided through the backwall 70. The projectile control mechanism 66 also includes a substantially cylindrical, hollow gas expulsion nozzle receptacle 72 having an outer diameter smaller than the sidewall 68 and depending forward from the backwall 70. The inner diameter of the gas expulsion nozzle receptacle 72 is substantially the same diameter as, and is aligned with, the axial through hole 71. The gas expulsion nozzle receptacle 72 and the remainder of the projectile control mechanism 66 may be formed as a single piece, as illustrated, or they may be formed as separate pieces that are fixed together subsequent to formation using known methods. For instance, the gas expulsion nozzle could be threaded or press fit into an aperture formed in the backwall 70 of the projectile control mechanism 66, or the gas expulsion nozzle and the backwall 70 could be formed as a single piece that is then threaded, press fit, or otherwise attached to the sidewall 68 of the projectile control mechanism 66.

When contained in the airgun 2, as illustrated in FIG. 6, the gas expulsion nozzle receptacle 72 receives the gas expulsion nozzle 46 of the valve body 11, and the projectile control mechanism 66 is movable relative to the valve body 11, such that the gas expulsion nozzle receptacle 72 slides over the gas expulsion nozzle 46.

Figure 8:
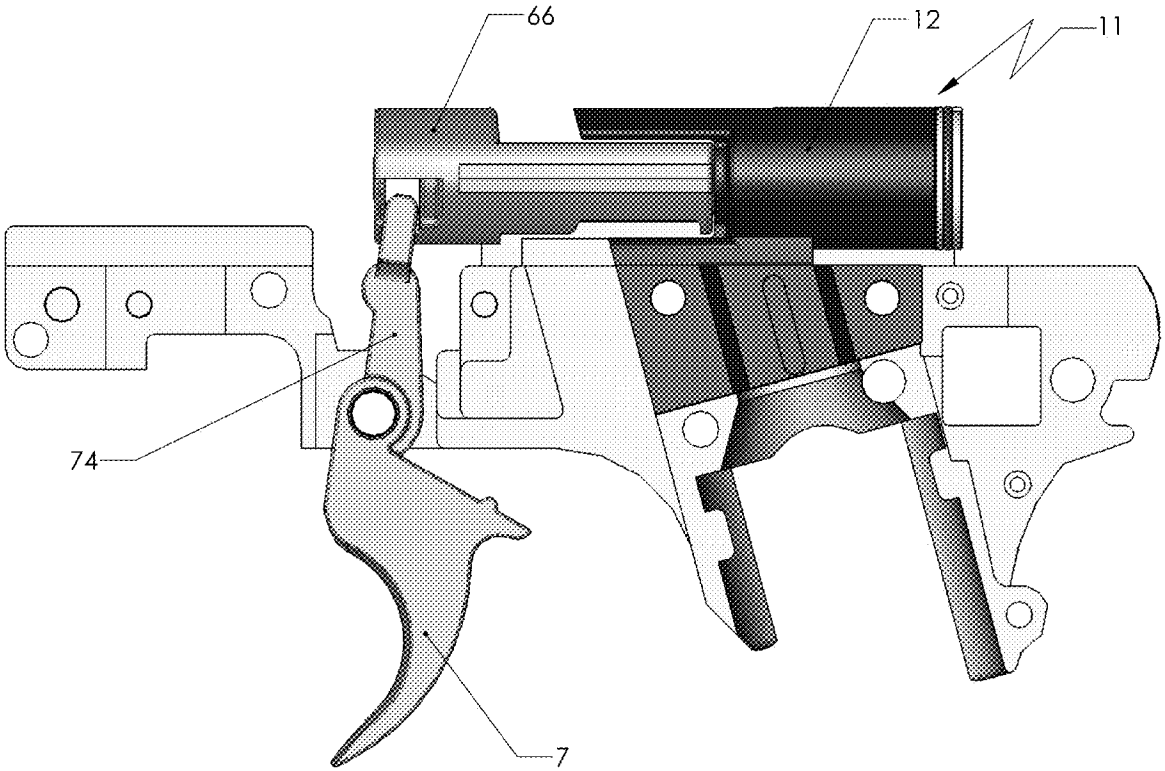
FIG. 8 is a plan view of a subassembly of the airgun of FIG. 1.
Figure 9:
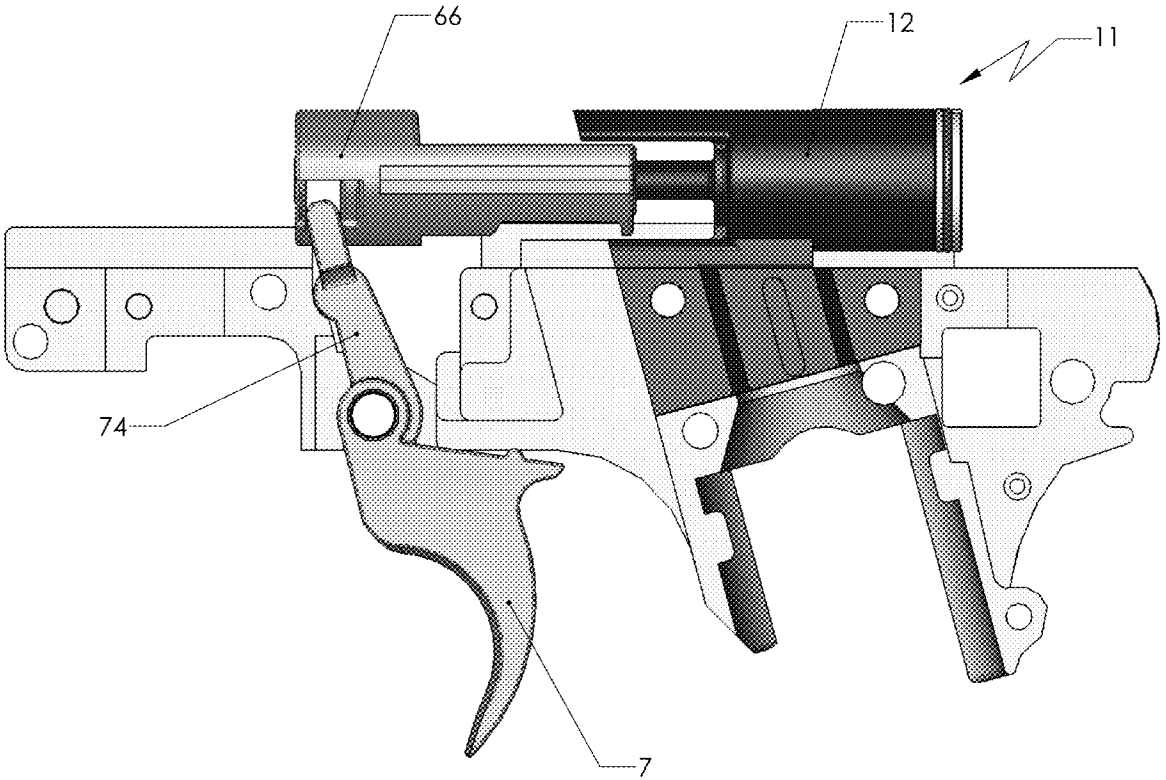
FIG. 9 is a plan view of the subassembly illustrated in FIG. 8, after the airgun has been fired.

As illustrated in FIGS. 8 and 9, a trigger link 74 provides a connection between a forward end of the projectile control mechanism 66 and the trigger 7. The projectile control mechanism 66 is movable along the firing axis between a load position and a firing position, by actuating the trigger 7. When the trigger 7 is in a ready-for-firing, or un-pulled, position, as illustrated in FIG. 8, the projectile control mechanism is in the loading position. In this position, the backwall 70 of the projectile control mechanism 66 is substantially in contact with the valve body 12, such that the gas expulsion nozzle is substantially completely contained within the gas expulsion nozzle receptacle. Pulling the trigger 7 advances the projectile control mechanism 66 to the firing position, as illustrated in FIG. 9. In the firing position, the backwall 70 of the projectile control mechanism 66 is spaced from the valve body 11, exposing a portion of the gas expulsion nozzle 46. The loading position and the firing position will be described in more detail below.

Although not illustrated, the trigger is connected to the hammer using conventional linkages. Accordingly, pulling the trigger 7, in addition to moving the projectile control mechanism 66 to the firing position, releases the cocked hammer.

Operation of the airgun 2 now will be described with specific reference to FIGS. 10A-10F.

Figure 10A:
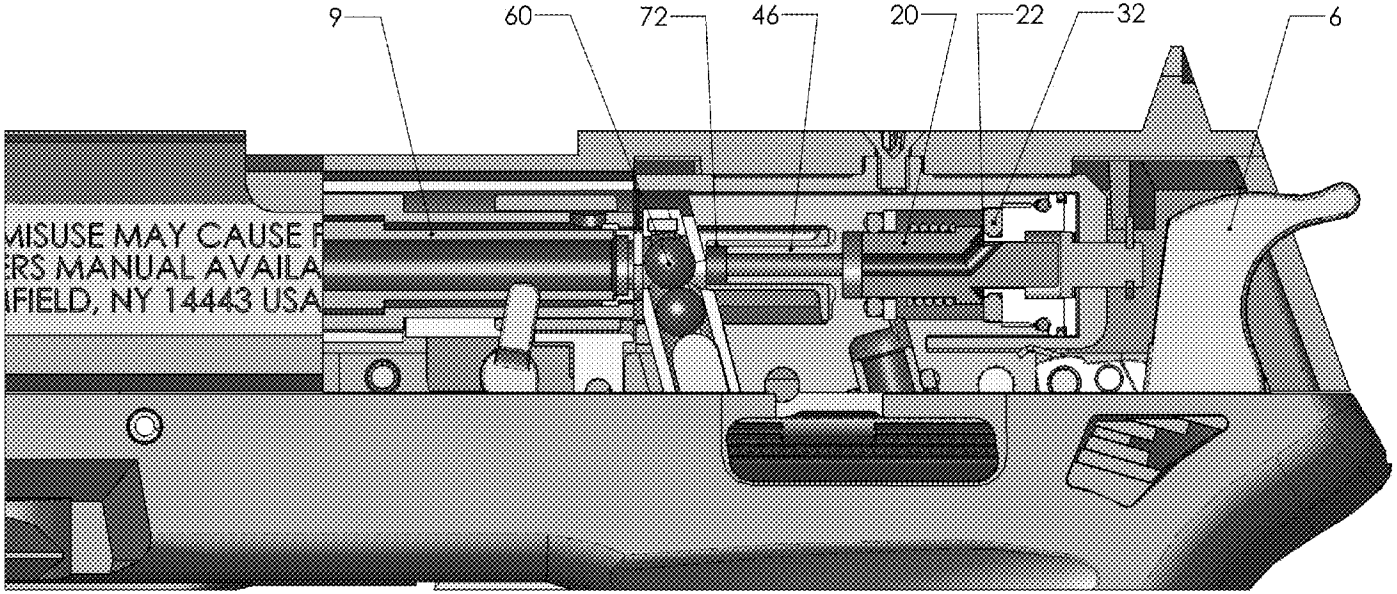
FIGS. 10A-10F are a series of partial cross-sectional views of the airgun of FIG. 1 showing the positioning of components of the airgun through a firing sequence.

FIG. 10A is a partial cut-away, partial cross-section of the airgun 2, and illustrates the normal, or un-cocked, gun position. As illustrated, in this position the valve seat 22 is seated against the valve seal 32 of the valve body 11 such that compressed air supplied through the gas supply port 15 is contained in the valve stem chamber 14. Also in this position, the projectile control mechanism 66 is disposed in the loading position, in which the projectile control mechanism 66 is situated in a rearward position, with the backwall 70 of the projectile control mechanism 66 contacting the valve body 11. In this position, the gas expulsion nozzle 46 is substantially completely contained within the gas expulsion nozzle receptacle 72, and, because of the bottom slot 69, the output 64 of the projectile feed cartridge 62 is unimpeded, such that a projectile 60 is fed into the projectile firing position in front of the gas expulsion nozzle 46 and behind an opening of the barrel 9, along the firing axis.

Figure 10B:
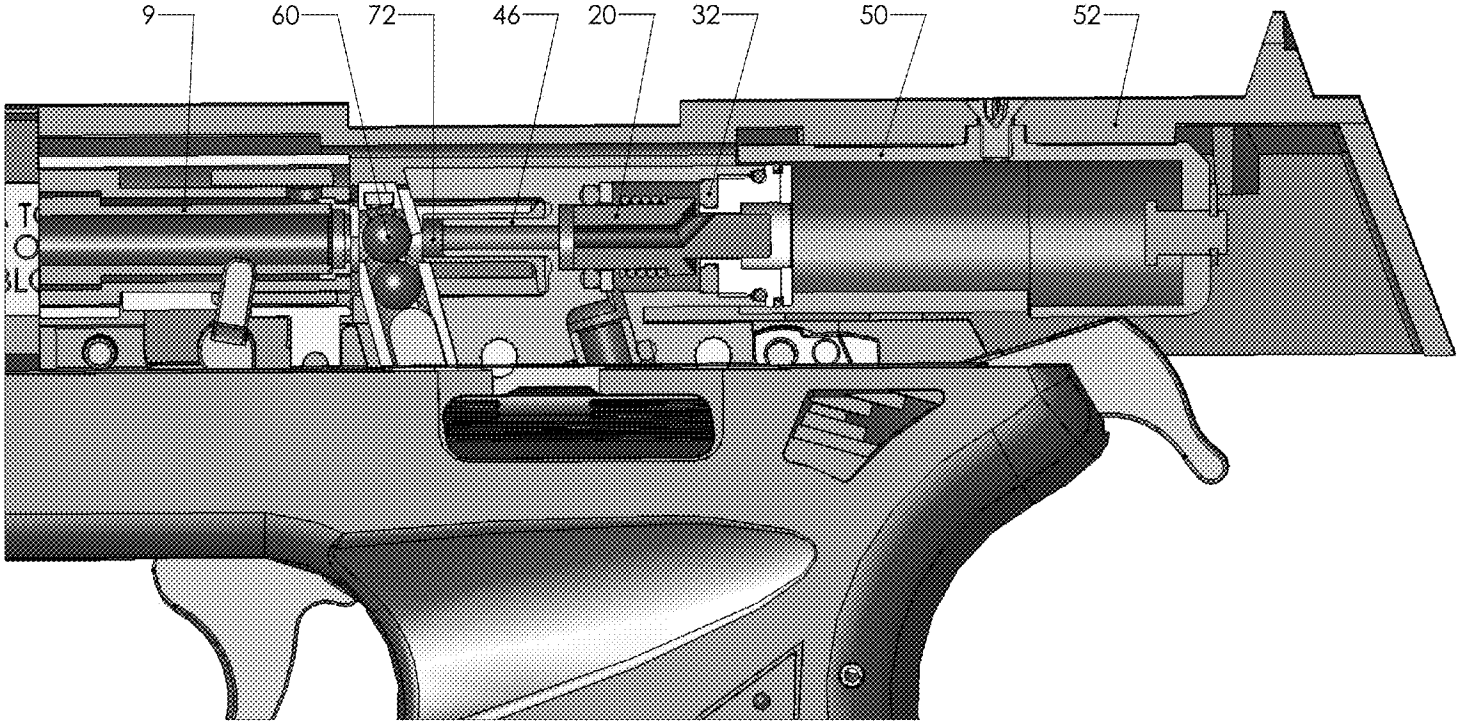
Figure 10C:
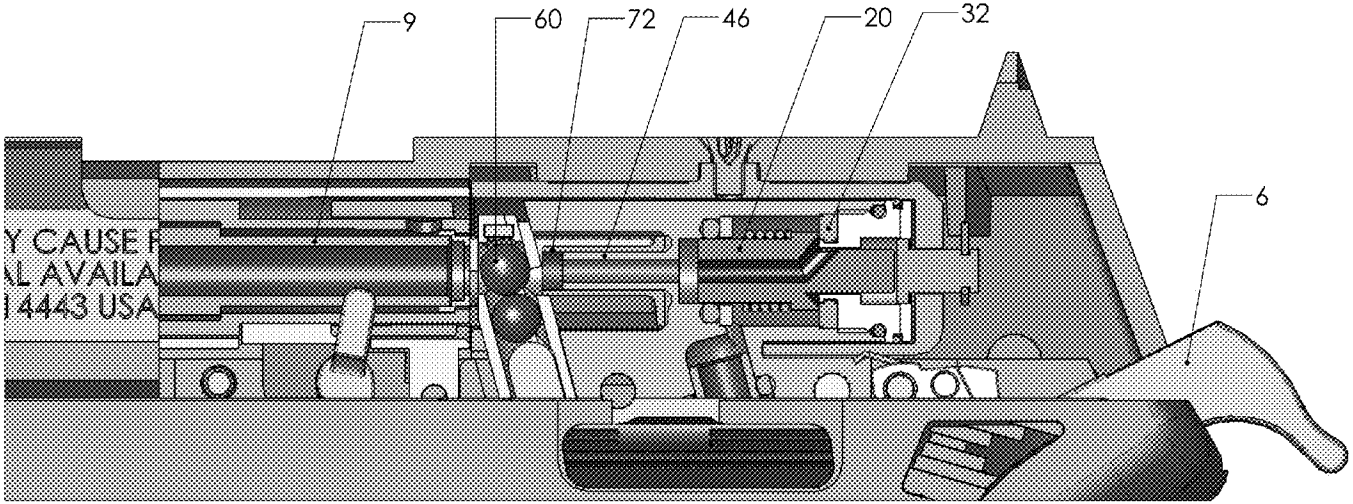

To ready the weapon for firing, as shown in FIG. 10B, a user manually moves the slide 52 relative to the rest of the gun in a direction away from the muzzle, causing the hit pin 48 and/or the cylinder 50 to contact, and eventually cock, the hammer 6. When the user releases the slide 52, the slide 52 returns to the forward-most position, and the hammer remains cocked (FIG. 10C).

Figure 10D:
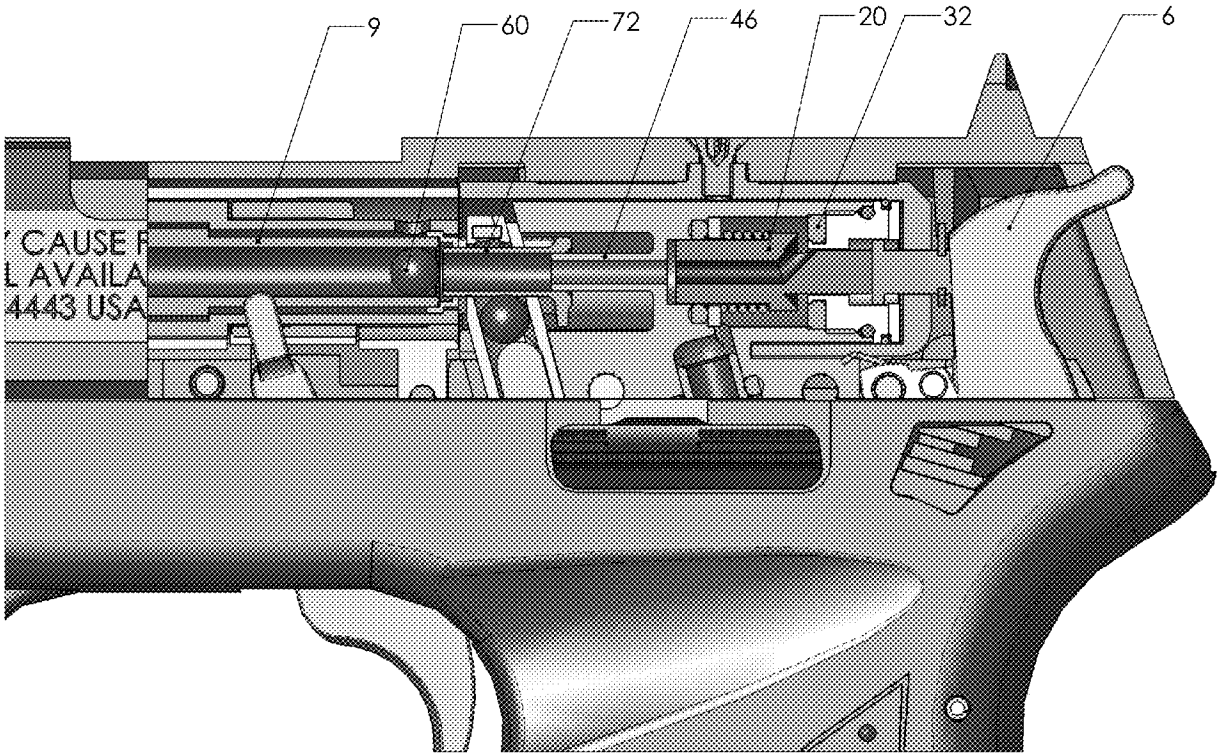

As illustrated in FIG. 10D, as the user pulls the trigger to fire the weapon, the projectile control mechanism 66 (via the trigger link 74) advances from the loading position to the firing position. The firing position is a forward position of the projectile control mechanism 66 in which the outer surface of the gas expulsion nozzle receptacle 72 covers the output 64 of the projectile feed cartridge 62. When moving from the load position to the firing position, the gas expulsion nozzle receptacle 72 contacts the single projectile contained in the projectile firing position and advances that projectile 60 into the barrel. In this firing position, the gas expulsion nozzle receptacle 72 precludes advancement of additional projectiles 60 into the firing position.

Pulling the trigger also releases the cocked hammer, and the hammer strikes the hit pin 48, which in turn contacts the striking surface 28 of the valve stem 20. The striking surface 28 of the valve stem 20 is struck by the hit pin 48 with sufficient force to overcome the biasing force of the valve stem return spring 34, unseating the annular valve seat 22 from the valve seal 32. With the valve seat unseated, gas rushes from within the valve stem chamber 14 between the annular valve seat 22 and the valve seal 32. Some of the gas flows into the opening 25 in the valve stem 20, through the diagonal orifice 44, along the axial bore 42, and is expelled from the valve stem 20 into the gas expansion chamber 40. The compressed gas then further is expelled through the gas expulsion chamber 47 and gas expulsion receptacle 72 to propel the loaded projectile through the barrel and from the gun.

Figure 10E:
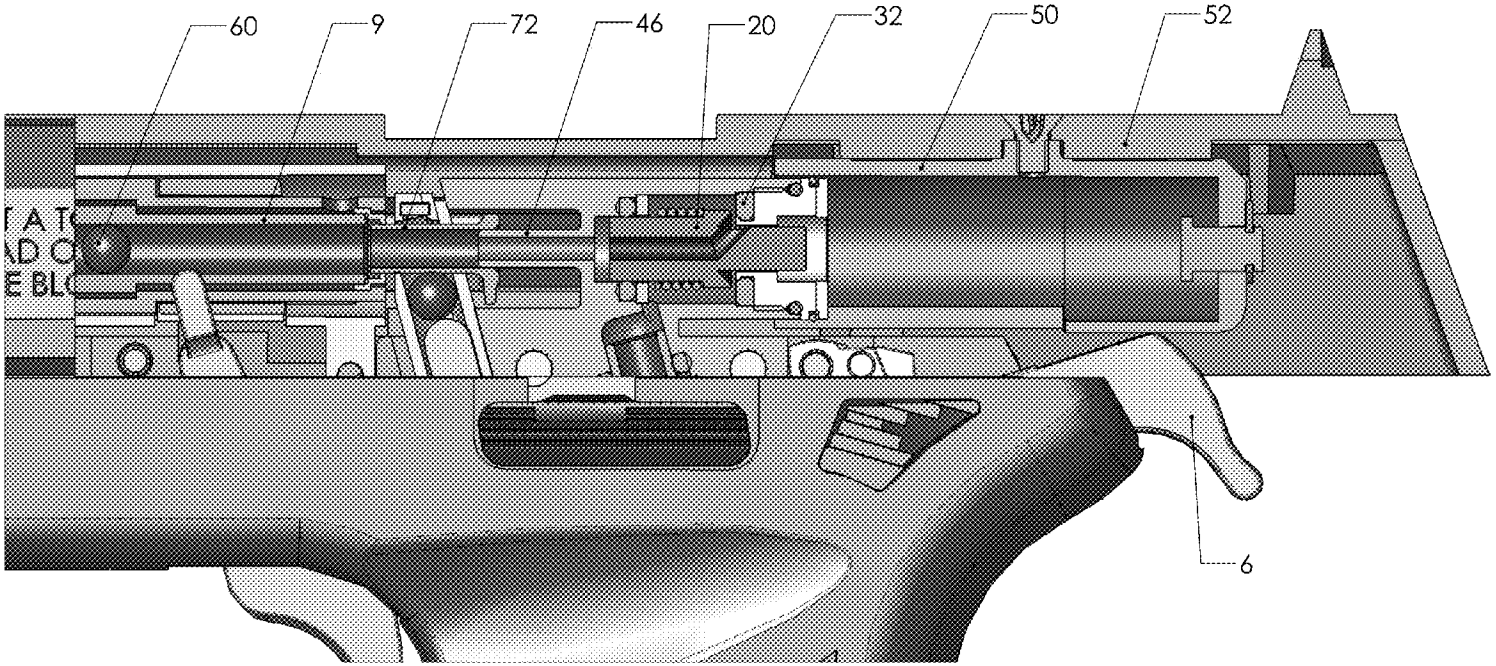
Figure 10F:
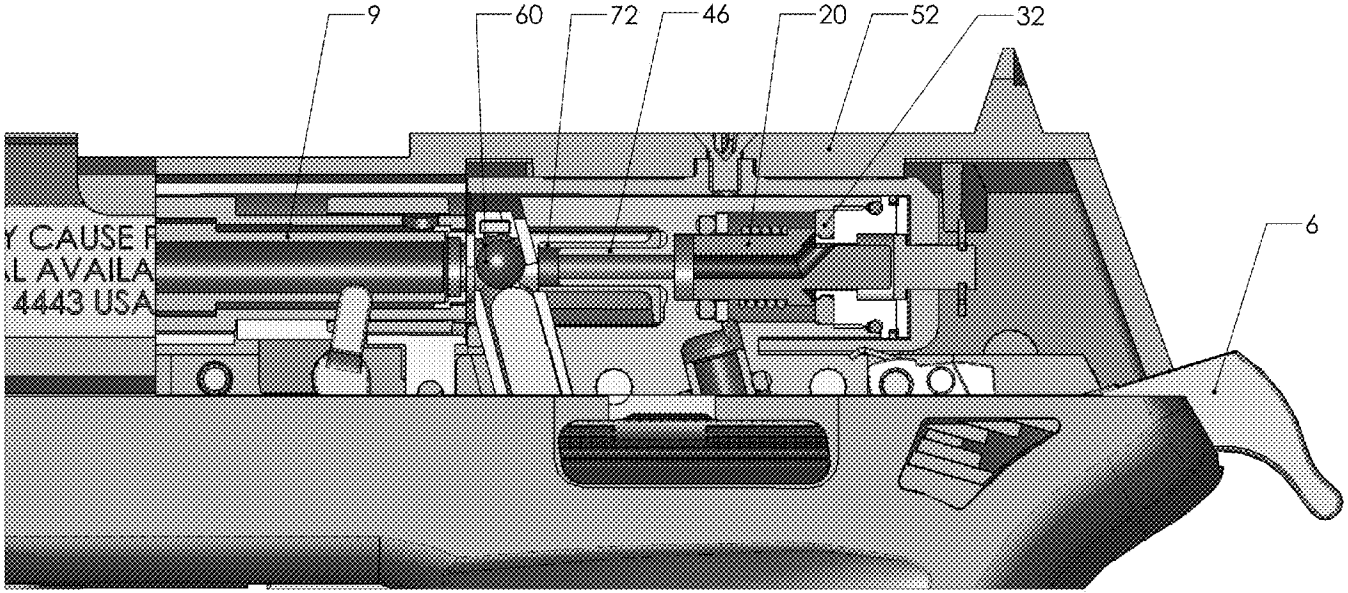

Instead of flowing through the opening 25 to fire the projectile 60, some of the gas rushing between the valve seat 22 and the valve seal 32 also flows toward the back of the gun, namely, through the blowback opening 31 in the valve body 11, around the rearward portion 26 of the valve stem 20. This gas contacts the backwall 56 of the cylinder 50 and/or the hit pin 48 with sufficient force to move the cylinder/slide 50/52 combination in a rearward direction, as shown in FIG. 10E. This rearward movement of the cylinder/slide combination is sufficient to re-cock the hammer, so the gun again is ready for firing; the user need not manually cock the weapon as shown in and described in connection with FIG. 10B.

The force of the hammer is sufficient to unseat the annular valve seat only momentarily, as the force of the valve stem return spring 34 quickly reseats the annular valve seat against the valve seal. Thus, the flow of gas between the annular valve seat and the valve seal is quickly stopped. The trigger 7 also is returned to its ready-for-firing position, thus also restoring the projectile control mechanism 66 in the loading position, such that the next projectile 60 is aligned for firing.

The foregoing embodiments of the invention are representative embodiments, and are provided for illustrative purposes. The embodiments are not intended to limit the scope of the invention. Variations and modifications are apparent from a reading of the preceding description and are included within the scope of the invention. The invention is intended to be limited only by the scope of the accompanying claims.

The invention claimed is:

1. A blowback assembly for a gun having a muzzle at a first end and a hammer at a second, opposite end, the blowback assembly comprising:

a valve body having an aperture extending therethrough, substantially axially the aperture having a stepped profile defining (i) a valve stem chamber, (ii) a gas expansion chamber on the muzzle-side of the valve stem chamber having a cross-sectional area smaller than a cross-sectional area of the valve stem chamber, (iii) a gas expulsion chamber arranged on the muzzle-side of the gas expansion chamber having a cross-sectional area smaller than the cross-sectional area of the gas expansion chamber, and (iv) a blowback opening arranged on a hammer-side of the valve stem chamber having a cross-sectional area smaller than the cross-sectional area of the valve stem chamber:

a gas supply port formed through the valve body to supply a compressed gas to the valve stem chamber; and a valve stem disposed in and movable with respect to the valve body, the valve stem having a stepped outer profile defining an annular valve seat intermediate a forward section and a rearward section, the annular valve seat having a cross-sectional area larger than a cross-sectional area of the forward section and larger than a cross-sectional area of the rearward section, the forward section extending into the gas expansion chamber of the valve body and the rearward section extending into the blowback opening, a clearance being formed between the blowback opening and the rearward section of the valve stem, the valve stem further comprising an internal passageway including an axial bore that terminates at an opening in a front end of the valve stem, the opening being coaxial with the valve stem, and at least one orifice, connecting an opening in a sidewall of the rearward section of the valve stem to the axial bore, wherein the valve stem is movable in an axial direction relative to the valve body from a normal position in which the annular valve seat is biased against a back wall of the valve stem chamber to a firing position in which the annular valve seat is spaced from the back wall of the valve stem chamber.

2. The assembly of claim 1, further comprising a valve seal positioned to form an airtight seal between the annular valve seat and the back wall of the valve stem chamber when the valve stem is in the normal position.

3. The assembly of claim 1, further comprising a seal contacting the forward portion of the valve stem to preclude air from flowing between the gas expansion chamber and the valve stem chamber.

4. The assembly of claim 1, further comprising a spring biasing the annular valve seat against the back wall of the valve stem chamber.

5. The assembly of claim 1, further comprising a cylinder axially movable relative to the valve body from a normal position to a cocking position, the cylinder comprising a sidewall and a backwall and the valve body being disposed in the cylinder such that the blowback opening of the valve body opens into a space defined by the sidewall and the backwall.

6. The assembly of claim 5, further comprising a hit pin contained within an opening formed in the back wall of the cylinder, the hit pin being movable with respect to the cylinder, substantially axially.

7. The assembly of claim 5, wherein the cylinder is moved from the normal position by compressed air passing through the blowback opening and applying a force to the backwall of the cylinder.

8. The assembly of claim 5, further comprising a slide fixed to the cylinder, the cylinder being movable from the normal position when a user actuates the slide.

9. The assembly of claim 1, wherein when a sufficient force is applied to a striking surface of the valve stem, a bias force maintaining the valve stem in the normal position is overcome, such that the valve stem unseats from the back wall of the valve stem chamber, allowing compressed gas contained in the valve stem chamber to escape from the valve stem chamber, between the annular valve seat and the back wall of the valve stem chamber.

10. The assembly of claim 9 wherein some of the compressed gas escaping from the valve stem chamber passes through the opening and axial bore of the valve stem and the some of the gas passes through the blowback opening.

11. The assembly of claim 10 wherein the gas passing through the valve stem is used to fire a projectile and wherein the gas passing through the blowback opening is used to cock a hammer.

12. An airgun comprising:

a valve body having a passageway formed substantially axially therethrough, the passageway having a stepped profile defining a valve stem chamber having a cross-sectional area, a gas expansion chamber having a cross-sectional area smaller than the cross-sectional area of the valve stem chamber, a gas expulsion chamber having a third cross-sectional area smaller than the cross-sectional area of the gas expansion chamber, and a blowback opening having a cross-sectional area smaller than the cross-section area of the valve stem chamber, a portion of the valve body surrounding the gas expulsion chamber forming a gas expulsion nozzle;

a valve stem disposed in and movable with respect to the valve body, the valve stem having a stepped outer profile defining a valve seat intermediate a forward face and a rearward face, a forward portion of the valve stem extending between the forward face and the valve seat and a rearward portion of the valve stem extending between the rearward face and the valve seat, the rearward portion having a cross-sectional area smaller than a cross-sectional area of the annular valve seat, the valve stem further comprising an internal passageway including an axial bore terminating at an opening in the forward face, the opening being coaxial with the valve stem, and an aperture terminating at an opening disposed on a side of the valve stem on a side of the annular valve seat opposite the forward face, the valve stem being disposed in the valve body with the forward portion contained in and sealed with respect to the gas expansion chamber, the valve stem disposed in the valve stem chamber, and the rearward portion contained in the blowback opening, the valve stem being movable from a normal position in which the valve seat is biased by a biasing force toward a backwall of the valve stem chamber, to a firing position in which the seal between the valve seat and the backwall of the valve stem chamber is broken; and a projectile control mechanism disposed on a muzzle side of the valve body and including a gas expulsion nozzle receptacle adapted to receive therein, and move with respect to, the gas expulsion nozzle of the valve body, the projectile control mechanism being movable between a normal position in which projectiles are fed into a projectile firing position and a firing position in which the gas expulsion nozzle receptacle precludes projectiles from being fed into the projectile firing position.

13. The airgun of claim 12, further comprising a trigger in communication with the projectile control mechanism, actuation of the trigger causing movement of the projectile control mechanism between the normal position and the firing position.

14. The airgun of claim 13, further comprising a cylinder disposed about the valve body and movable with respect to the valve body, the cylinder having a back wall arranged proximate the blowback opening of the valve body, compressed air ejected from the valve stem chamber through the blowback opening applying a force to the back wall of the cylinder sufficient to move the cylinder relative to the valve body.

15. The airgun of claim 14, further comprising a hammer movable between a cocked position and a striking position, actuation of the trigger releasing the hammer from the cocked position causing application of a striking force to the rearward face of the valve stem as the hammer moves to the striking position.

16. The airgun of claim 15, wherein the striking force overcomes the bias force to break the seal formed between the valve seat and the back wall of the valve stem chamber.

17. The airgun of claim 16, wherein compressed gas supplied to the valve stem chamber is discharged between the valve seat and the back wall of the valve stem chamber when the seal formed between the valve seat and the back wall of the valve stem chamber is broken.

18. The airgun of claim 17, wherein some of the compressed gas enters the internal passageway in the valve stem via the opening disposed on the side of the valve stem and is expelled through the axial bore into the gas expansion chamber and out the gas expulsion chamber, and wherein some of the compressed gas is expelled through the blowback opening to contact the rear wall of the cylinder.

19. The airgun of claim 18, further comprising a barrel, an opening of the barrel arranged proximate the projectile firing position, a projectile arranged in the projectile firing position being forced through the barrel by compressed gas ejected from the gas expulsion nozzle.

20. An airgun comprising:

a barrel through which projectiles are shot from the airgun;

a projectile control mechanism controlling the placement of projectiles to be shot through the barrel;

a blowback assembly cooperating with the projectile control mechanism to selectively introduce compressed gas to shoot projectiles, the blowback assembly comprising a valve body and a valve stem disposed within and movable with respect to the valve body, the valve body having a stepped inner profile defining a valve stem chamber, a gas expansion chamber having a cross-sectional area smaller than a cross-sectional area of the valve stem chamber, and a gas expulsion chamber having a cross-sectional area smaller than the cross-sectional area of the gas expansion chamber, the valve stem chamber having a rear wall opposite the gas expansion chamber and a blowback opening being formed through the rear wall, the valve stem having a stepped outer profile defining, in order along its axis, a forward portion configured to be received in the gas expansion chamber, a valve seat configured to be received in the valve stem chamber, and a rearward portion configured to be received in the blowback opening and having a cross-sectional area smaller than the cross-sectional area of the valve seat, the valve stem further comprising an internal passageway extending from an opening in a front face, the opening being coaxial with the valve stem, to an opening on a sidewall of the rearward portion, the valve stem being movable relative to the valve body from a normal position in which the valve seat creates a seal with the valve body to contain compressed gas in the valve stem chamber to a firing position in which compressed gas in the valve stem chamber discharges from the valve stem chamber through an opening created when the seal between the valve seat and the valve body is broken;

a cylinder having a sidewall and a back wall, the valve body being disposed in the cylinder and the cylinder being movable with respect to the valve body from a normal position in which the back wall of the cylinder is arranged proximate the rearward portion of the valve stem to a cocking position in which the back wall of the cylinder is spaced from the rearward portion of the valve stem;

a slide fixed to the cylinder and facilitating movement by a user of the cylinder from the normal position to the cocking position;

a hit pin disposed in the back wall of the cylinder;

a hammer movable between a cocked position and a firing position, in the firing position, the hammer contacting the hit pin to apply a striking force to the valve stem to overcome the bias force maintaining the seal between the valve seat of the valve stem and the back wall of the valve body; and a movable trigger communicating with the projectile control mechanism to actuate the projectile control mechanism from a normal position allowing loading of a projectile into the firing position and a firing position precluding entry of a projectile into the projectile firing position and communicating with the hammer to advance the hammer from the cocked position to the firing position.

* * * * *